United States Patent [19]

Kirck

[11] Patent Number: 4,674,630

[45] Date of Patent: Jun. 23, 1987

[54] REED CASE

[76] Inventor: George T. Kirck, P.O. Box 1217, Westbrook, Me. 04092

[21] Appl. No.: 819,564

[22] Filed: Jan. 17, 1986

[51] Int. Cl.[4] ..... B65D 81/22

[52] U.S. Cl. ..... 206/205; 84/456; 206/314; 312/31

[58] Field of Search ..... 206/204, 205, 314; 84/341, 346, 453, 456, 351; 220/8; 312/31, 31.01, 31.02–31.06, 31.1–31.3

[56] References Cited

U.S. PATENT DOCUMENTS

| | | | |
|---|---|---|---|
| 1,997,820 | 4/1935 | Govoni | 206/314 |
| 2,524,162 | 10/1950 | Chavannes et al. | 312/31 |
| 3,081,137 | 3/1963 | Kolokythas | 312/31.1 |
| 3,203,298 | 8/1965 | Sumrall | 206/314 |
| 4,250,995 | 2/1981 | Lorenzini | 206/314 |
| 4,352,428 | 10/1982 | Pascucci et al. | 206/314 |
| 4,428,892 | 1/1984 | Berliner | 312/31.01 |

FOREIGN PATENT DOCUMENTS

| | | | |
|---|---|---|---|
| 0609247 | 5/1926 | France | 206/314 |
| 0630797 | 8/1927 | France | 206/314 |

*Primary Examiner*—William Price
*Assistant Examiner*—Jimmy G. Foster
*Attorney, Agent, or Firm*—Fred L. Denson

[57] ABSTRACT

A portable, self-enclosed reed case that maintains the environment most conducive to woodwind reed maintenance. The reed case comprises a main enclosure that is divided by an aerated partition into a reed chamber and a hygrostat chamber, a reed slide adapted to receive and releasably secure a plurality of reeds, and a hygrostat container adapted to receive a hygrostat that maintains a constant relative humidity. The reed slide and hygrostat container, when assembled into the reed chamber and hygrostat chamber, respectively, form an interaction unit that maintains the reeds in a "ready-to-play" state.

4 Claims, 14 Drawing Figures

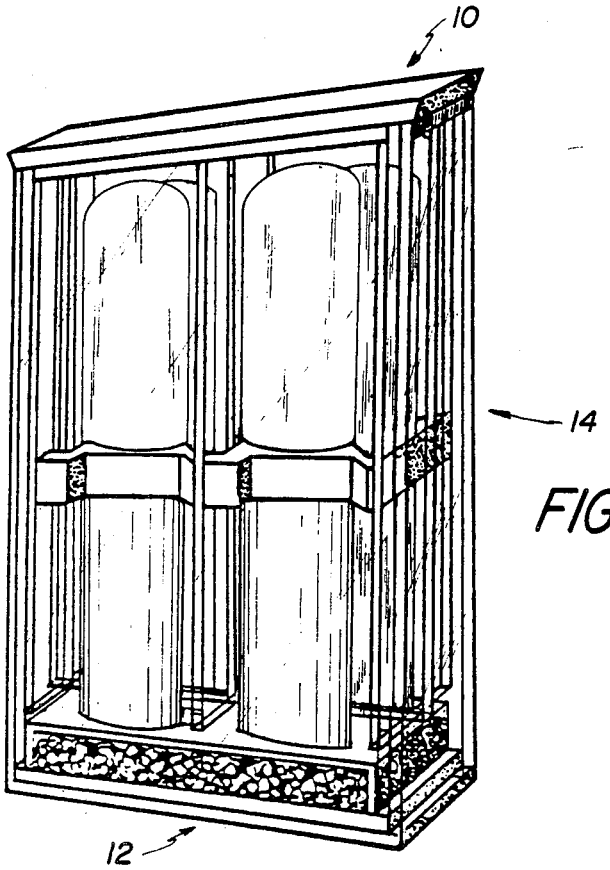
FIG. 1
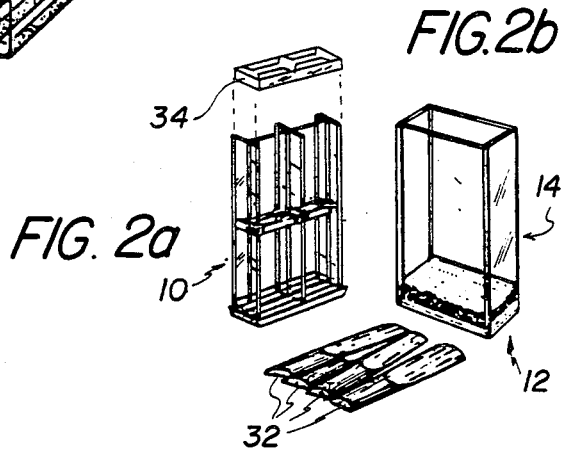
FIG. 2a
FIG. 2b
FIG. 2c

FIG. 4a
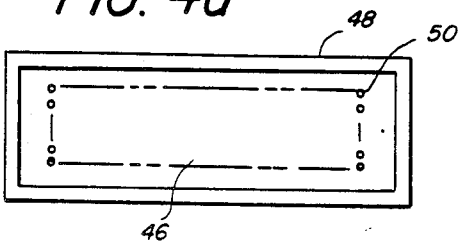
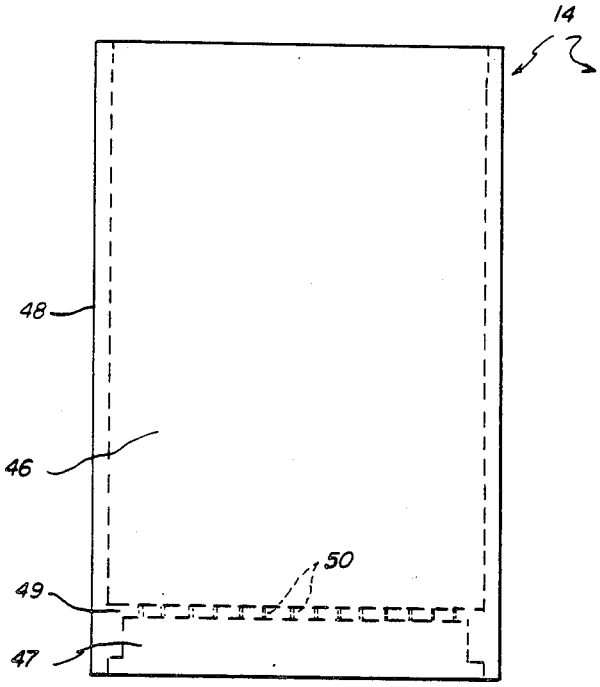
FIG. 4b
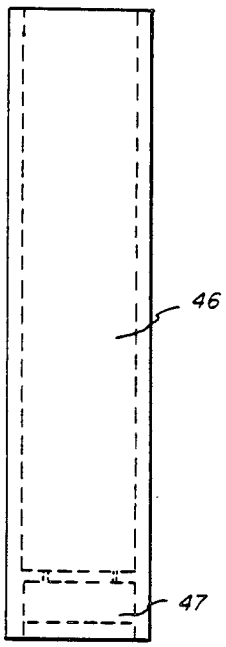
FIG. 4c

FIG. 5a
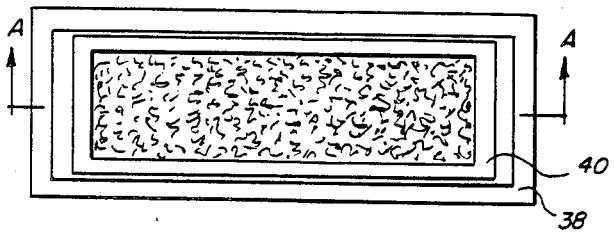
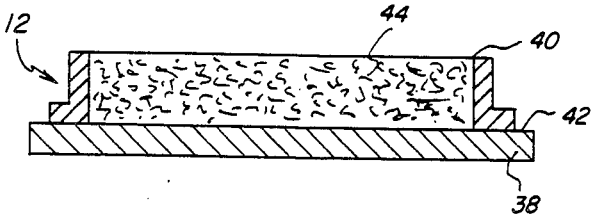
FIG. 5b
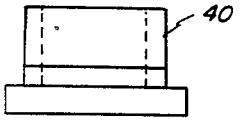
FIG. 5c
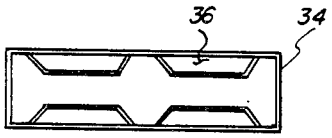
FIG. 6

REED CASE

BACKGROUND OF THE INVENTION

1. Field of the Invention

The present invention relates to apparatus for storing musical cane reeds (arundo donax). More particularly, the invention relates to a portable, self-enclosed reed case that maintains the optimum environment for the storage of musical cane reeds.

2. Description Relative to the Prior Art

The conditions under which a reed for musical woodwind instruments is stored when not in use have a considerable effect on the ease with which the reed may be restored to a playable condition. A reed that is in use comes from the mouthpiece of an instrument at a relative humidity of approximately 100%. When placed in a storage container, or in some other way exposed to the atmosphere, the reed will drop in moisture content until an equilibrium is reached with the environment. A reed stored under dry conditions will undergo an extreme and swift moisture exchange. The more radical the moisture difference, the more profound the effect upon the reed's internal fiber structure, which in response changes shape and causes splitting and warpage. On the other hand, a reed stored under wet conditions is subject to mold and mildew. For extended reed usefullness and performance quality, it has been found that reeds should be stored at a constant relative humidity of approximately 75%.

Currently, there are three types of reed holders that are commercially available. The first type of reed holder consists of a stiff paper sleeve or envelope into which a single reed's vamp (thin end) is slipped. This type of holder offers little protection and is generally considered to be unsatisfactory by the serious woodwind performer. A second type of holder, known as a reed "clip", secures (clips) one or more reeds to a flat slot-like metal or polymer surface. While such clips do provide a flat surface for moistured reeds to dry against, they do not maintain reed moisture at a level which permits the reed to be readily restored to playing condition. The third type of reed holder is fashioned from leather, wood, cloth or some combination of these materials and takes the form of a snapped or zippered billfold-like enclosure. One such holder, known as the REED PAK TM, manufactured by Sounds of Woodwinds Inc., Box 91, Hancock, Mass., 01237, has a compartmented, plastic insert which holds a plurality of reeds against a flat partition. The insert is enclosed by a case lined with a soft plastic foam which may be moistened to prevent rapid drying of the reeds. While the moistened foam provides some environmental improvement over the aforementioned reed clips, such foam must be moistened frequently to maintain reed moisture and there is always the problem that over wetting of the foam may lead to mold, mildew and/or other problems.

SUMMARY OF THE INVENTION

In accordance with the present invention, an improved storage case for musical cane reeds is provided which maintains a constant, optimum relative humidity for reed storage. The storage case of the present invention comprises (1) a slidable member having a flat surface adapted to receive at least one musical cane reed, (2) a spring for each reed received by the flat surface for releasably securing such reed to the slidable member, and (3) an enclosure case comprising a slide chamber adapted to receive the slidable member with a snap fit, a hygrostat chamber adapted to receive a hygrostat, and an aerated partition located between the slide chamber and the hygrostat chamber. A variety of chemical/mineral hygrostats and fiber/sponge hygrostat-like materials are useful with the storage case of the present invention. A particularly useful hygrostat consists of a mixture of sodium chloride, silica gel and activated charcoal.

The storage case of the present invention, when used with a hygrostat such as mentioned above, maintains a constant relative humidity of approximately 75% during reed storage. Such constant storage conditions provide a number of advantages over the prior art reed storage containers. Reed warpage is minimized and reed tip wrinkle is eliminated. The reeds are kept moist, so that minimum warm-up time is required before playing, without developing mold or mildew. As a result of the aforementioned advantages, reed life and performance quality are extended.

The invention and its objects and advantages will become more apparent by referring to the accompanying drawings and to the ensuing detailed description of the preferred embodiment.

BRIEF DESCRIPTION OF THE DRAWINGS

FIG. 1 is a perspective view of a reed storage case according to the invention;

FIGS. 2A, 2B and 2C are, respectively, perspective views of the reed slide with a reed slide spring, the main case that holds the reed slide, and four musical cane reeds which can be stored in the storage case of FIG. 1;

FIGS. 4A, 4B and 4C are, respectively a plan view, a front elevational view, and a side view of the main enclosure that receives the reed slide and the hygrostat container;

FIGS. 5A, 5B and 5C are, respectively, a plan view, a front sectional view taken along line A—A of FIG. 5A, and a side view of the hygrostat container; and FIG. 6 is a plan view of a reed slide spring.

DETAILED DESCRIPTION OF THE PREFERRED EMBODIMENTS

Figure 3A:
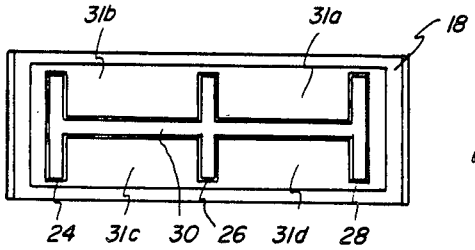
FIGS. 3A, 3B and 3C are, respectively, a plan view, a front elevational view, and a side view of the reed slide.

Referring now to the drawings, reference numeral 10 generally designates a reed slide adapted to receive a plurality of musical cane reeds in individual compartments. Reference numeral 12 generally designates a hygrostat container adapted to receive a hygrostat described in detail herein below. Reference numeral 14 generally designates a main enclosure case divided by a partition 49 into a larger reed chamber 46 adapted to receive the reed slide 10 and a smaller hygrostat chamber 47 adapted to receive the hygrostat container 12.

Figure 3B:
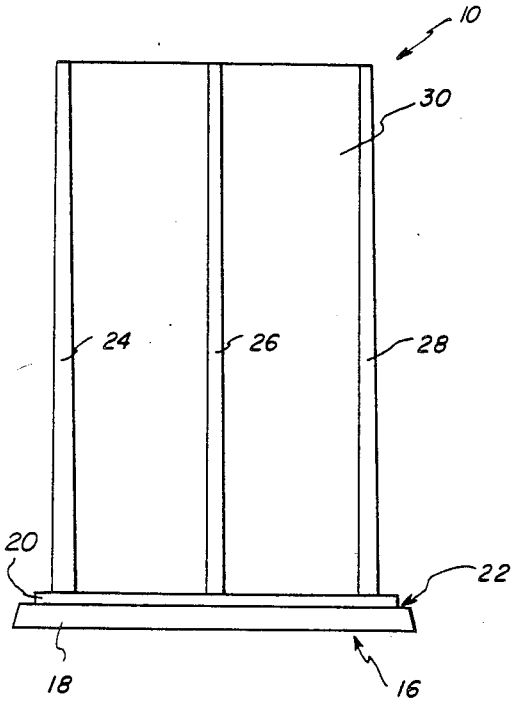
Figure 3C:
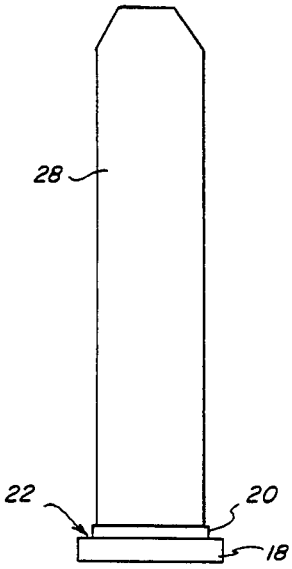

As best shown in FIGS. 3A, 3B and 3C, the reed slide 10 includes a base 16, having a flat outside surface 18 on which the reed slide can be supported, when outside of the reed chamber 46, for easy reed viewing and systematic reed break-in manipulations. The base 16 has an inside surface 20 which is smaller than the outer surface 18 and forms a lip 22 therewith. The lip 22 permits the reed slide 10 to be inserted into the open-ended top of the reed chamber 46 with a snap fit that forms an almost air-tight seal. Extending vertically from the inside base surface 20 are three side walls 24, 26 and 28, respectively, and a flat, rigid center wall 30. The center wall 30 is perpendicular to and vertically bisects each of the side walls 24, 26 and 28 to form four separate reed compartments, 31*a*, 31*b*, 31*c* and 31*d*, respectively.

Each of four reeds, 32, shown in FIG. 2C, is secured to a portion of the center wall 30 forming the rear wall of the reed compartments 31*a–d*, by means of reed spring 34, one of which is shown in FIG. 6. Spring 34 contains four separate spring areas 36 which serve to clamp each of the four reeds stored in reed compartments 31*a–d*. Spring 34 is fitted onto reed slide 10 as shown in FIG. 2A. The surface of area 36 tends to conform to the particular cut or curvature of the individual reed being secured, as the spring is flexed into position in the reed compartment. The spring 34 holds the reeds 32 in the reed compartments 31*a–d* at a central location which tends to apply pressure evenly over the full length of each reed. This helps to minimize uneven drying and asymetrical warpage.

The hygrostat container 12 comprises a base 38 and an open-ended rectangular receptacle 40 having a lip structure 42 which permits the container 12 to be snapped into the open-ended bottom of the hygrostat chamber 47 with an almost air-tight seal.

The receptacle 40 is filled with a hygrostat 44 which operates to maintain the relative humidity of the reed chamber 46 at a constant relative humidity of approximately 75%. A variety of chemical compounds and mixtures are useful hygrostats according to the described invention. Examples of useful compounds and their hydrates are:

$KOH+KOH.H_2O$
$CaCl_2+CaCl_2.H_2O$
$NaOH+NaOH.3\frac{1}{2}H_2O$
$K_2CO_3+K_2CO_3.2H_2O$
$NaI+NaI.2H_2O$
$Na_2CO_3+Na_2CO_3.H_2O$
$CaCl_2.H_2O+CaCl_2.6H_2O$
$Na_2HPO_4.2H_2O$
$NaBr+NaBr.2H_2O$
$Na_2HPO_4.2H_2O+Na_2HPO_4.7H_2O$
$Na_2CO_3.H_2O+Na_2CO_3.10H_2O$
$Na_2HPO_4.7H_2O+Na_2HPO_4.12H_2O$
$Na_2SO_4+Na_2SO_4.10H_2O$
$P_2O_5$
KOH
NaOH
$CaBr_2.6H_2O$
$KC_2H_3O_2$
$CaCl_2.6H_2O$
$MgCl_2.6H_2O$
$K_2CO_3.2H_2O$
$Ca(NO_3)_2.4H_2O$
$Mg(NO_3)_2.6H_2O$
$NaBr.2H_2O$
$NH_4NO_3$
$SrCl_2.6H_2O$
NaCl
$NaNO_3$
KCl
$Na_2SO_4.10H_2O$
$Na_2CO_3.10H_2O$
$BaCl_2.2H_2O$
$KNO_3$ Any of several well known fiber/sponge hygrostat-like materials can also be used.

An especially useful hygrostat comprises a mixture of sodium chloride (NaCl), silica gel ($SiO_4$) and activated charcoal. Sodium chloride maintains a stabilized humidity over a wide temperature range (10° C.–30° C.). Silica gel has a colloidal character and initially functions as a desiccant (drying agent). With use, the silica gel comes into a relative state of equilibrium but does so much more slowly than sodium chloride. Thus, the silica gel functions not only to control humidity but to stabilize moisture exchange over time. The activated charcoal absorbs free organic molecules. Thus, it functions as a chemical "filter" that slows organic activity and helps to reduce odors. The composition of the hygrostat can be varied to obtain various constant relative humidities. Plant charcoal, such as that derived from coconut shell, is a particularly useful type of activated charcoal. As used herein, the term hygrostat includes hygrostat-like materials such as the aforementioned fiber/sponge material.

The main enclosure case 14 comprises a rectangular enclosure 48 and an aerated partition 49. The enclosure 48 is open-ended at both its top and bottom for receiving, respectively, the reed slide 10 and the hygrostat container 12. The upper surface of the partition 49 serves as an abutment for the side walls and center wall of the reed slide 10, and in cooperation with the base lip 22 provides the aforementioned snap fit for the reed slide. Likewise, the lower surface of the partition 49 serves as an abutment for the hygrostat container 40, and in cooperation with the container lip 42 provides the aforementioned snap fit for the hygrostat container 12. The better the snap fit between the main enclosure case 14 and the reed slide 10 and the hygrostat container 12, the more efficient the air seals between these components. The more efficient the air seal, the more stable the hygrostat effect.

With regard to structural specifications of the main enclosure case, the air passages 50 in the partition 49 are small enough to retain the hygrostat 44 while allowing for free vapor exchange between the reed chamber 46 and the chemical chamber 47. Furthermore, the enclosure 48 of the main case 14 is preferably manufactured from a plastic polymer resin such as LEXAN® which is substantially transparent. A transparent enclosure is advantageous because it provides (1) easy reed viewing and monitoring during storage, and (2) the introduction of light into the system which aids in the retardation of mold and mildew development. In the preferred embodiment the reed spring 34 is also manufactured from a substantially transparent plastic resin.

To use the reed storage case of the present invention, a reed (or reeds) is soaked as in preparation for playing. Excess moisture is wiped from the reed surfaces and the reed is slid, vamp (thin end) first, into the reed slide 10 through area 36 of reed spring 34. The reed slide 10 is then slid into the reed chamber 46 of the main case 14. When the reed slide 10 snaps securely into the reed chamber 46, the reeds 32 are in a storage state and will attain a relatively constant stable humidity. During such storage the environmentally conditioned reeds are protected from breakage or other accidental damage.

As the reed storage case is used, there is a swing from the closed storage state to the open reeds-in-use state. If the reeds are dry, more moisture may be introduced into the system by soaking the reeds a longer period before returning them to the case. Care must be taken not to introduce too much moisture, especially too quickly, as humidity near 100% may cause mold and mildew. If the reeds are too moist, the reed slide 10 may be allowed to remain out of the reed chamber 46 longer and/or a dry reed may be added to the reed slide. A dry reed will take on moisture when stored in the reed chamber and will in this way reduce the moisture content of each individual reed.

The invention has been described in detail with reference to a preferred embodiment thereof, but it will be understood that variations and modifications can be effected within the spirit and scope of the invention. For example, the reed slide 10 can be adapted to receive double reeds used in such instruments as oboes and bassoons.

If desired, the contents of the reed chamber 46 can be maintained by a temperature/pressure gauge and an electronic control device which, in response to the gauge, automatically varies one or more of the environmental conditions (temperature, pressure, humidity, etc.).

The reed storage case of the present invention can also be provided with a piston-like arrangement for drawing air out of the reed chamber to make it more of a vacuum. This will, in turn, draw water from the enclosed reed and suspend it as a vapor. The suspended vapor will speed moisture transfer and cause equilibrium to be reached in faster time. While rectangular components have been described for discussion purposes, the case and its components can be circular, oblong or any other suitable or desired shape.

Other principles employed for the design and function of the reed case of this invention are readily transferable to other useful applications. It will be readily apparent to those skilled in the art that a hygro-type case for violin and other stringed instruments employing the features of this invention will produce the same beneficial effects. Wooden instruments require moisture to maintain their shape and playing condition. A hygro-type case similar in design and operation to the case of this invention may be used for the storage of fine violins and other stringed instruments in that they tend to dry out and crack. Another application for a hygro-type case similar in design to the one described herein, is for the storage of cigarettes, cigars, etc. under controlled moisture conditions.

I claim:

1. Storage apparatus for musical cane reeds, said apparatus comprising:

a slidable member, said slidable member including a flat surface adapted to receive at least one musical cane reed, spring means for releasably securing a musical cane reed to said slidable member, and an enclosure case, said enclosure case comprising a slide chamber configured to receive said slidable member, a hygrostat chamber adapted to receive a hygrostat, and an airpervious partition located between said slide chamber and said hygrostat chamber with means for retaining said slidable member in said slide chamber with a snap fit.

2. Storage apparatus according to claim 1 wherein said slidable member, said spring means and said enclosure case are manufactured from a substantially transparent plastic resin.

3. Storage apparatus according to claim 1 including a chemical/mineral hygrostat or a fiber/sponge hygrostat.

4. Storage apparatus according to claim 1 including a hygrostat comprising a mixture of sodium chloride, silica gel and charcoal.

* * * * *